US011867173B2

(12) United States Patent
Imai et al.

(10) Patent No.: US 11,867,173 B2
(45) Date of Patent: Jan. 9, 2024

(54) SCROLL COMPRESSOR

(71) Applicant: Sanden Automotive Components Corporation, Isesaki (JP)

(72) Inventors: Tetsuya Imai, Isesaki (JP); Taizo Sato, Isesaki (JP)

(73) Assignee: SANDEN CORPORATION, Isesaki (JP)

( * ) Notice: Subject to any disclaimer, the term of this patent is extended or adjusted under 35 U.S.C. 154(b) by 239 days.

(21) Appl. No.: 17/438,832

(22) PCT Filed: Mar. 16, 2020

(86) PCT No.: PCT/JP2020/011352

§ 371 (c)(1),
(2) Date: Sep. 13, 2021

(87) PCT Pub. No.: WO2020/196002

PCT Pub. Date: Oct. 1, 2020

(65) Prior Publication Data

US 2022/0136500 A1 May 5, 2022

(30) Foreign Application Priority Data

Mar. 22, 2019 (JP) ..... 2019-054525

(51) Int. Cl.
*F04C 18/02* (2006.01)
*F04C 23/00* (2006.01)
(Continued)

(52) U.S. Cl.
CPC ..... *F04C 18/0215* (2013.01); *F04C 18/0261* (2013.01); *F04C 23/008* (2013.01);
(Continued)

(58) Field of Classification Search
CPC ..... F04C 18/0215; F04C 18/0261; F04C 23/008; F04C 28/28; F04C 29/068; F04C 29/026; F04C 29/065; F04C 29/12
See application file for complete search history.

(56) References Cited

FOREIGN PATENT DOCUMENTS

CN 108700070 A 10/2018
JP 2010-151060 A 7/2010
(Continued)

OTHER PUBLICATIONS

English JP-201015060 by PE2E (May 2, 2023).*
(Continued)

*Primary Examiner* — Deming Wan
(74) *Attorney, Agent, or Firm* — Baker Botts L.L.P.

(57) ABSTRACT

[Problem] A scroll compressor is provided which is capable of effectively reducing a pressure loss in a pathway extending from a discharge space to a discharge port.
[Solution] The scroll compressor includes a discharge space 27 formed in a compressing mechanism cover 9 of a housing 11, a discharge hole 26 which is formed in a fixed scroll 21 and discharges a compressed refrigerant to the discharge space, a discharge port 51 which discharges the refrigerant to the outside of the housing, a relief passage 71 which communicates the discharge space and the discharge port with each other, and a differential pressure valve 74 which is provided in the relief passage and opens in accordance with a pressure difference between the discharge space and the discharge port. The relief passage opens in the discharge space above the discharge hole.

6 Claims, 2 Drawing Sheets

(51) Int. Cl.

| | |
|---|---|
| ***F04C 28/28*** | (2006.01) |
| ***F04C 29/06*** | (2006.01) |
| ***F04C 29/02*** | (2006.01) |

(52) U.S. Cl.

CPC ..... *F04C 28/28* (2013.01); *F04C 29/026* (2013.01); *F04C 29/065* (2013.01); *F04C 29/068* (2013.01); *F04C 2240/30* (2013.01)

(56) References Cited

FOREIGN PATENT DOCUMENTS

| | | | | | |
|---|---|---|---|---|---|
| JP | 2010151060 | A | * | 7/2010 | ..... F04C 28/28 |
| JP | 2017-166366 | A | | 9/2017 | |
| JP | 2018-112130 | A | | 7/2018 | |

OTHER PUBLICATIONS

First Chinese Office Action Application No. 202080021439.6, dated Oct. 13, 2022.

Japan Patent Office, International Search Report issued in International Application No. PCT/JP2020/011352, dated Jun. 2, 2020.

* cited by examiner

SCROLL COMPRESSOR

CROSS-REFERENCE TO RELATED APPLICATIONS

This application is a U.S. National Stage Patent Application under 37 U.S.C. § 371 of International Patent Application No. PCT/JP2020/011352, filed on Mar. 16, 2020, which claims the benefit of Japanese Patent Application No. JP 2019-054525, filed on Mar. 22, 2019, the disclosures of each of which are incorporated herein by reference in their entirety.

TECHNICAL FIELD

The present invention relates to a scroll compressor which compresses a working fluid in a compression chamber formed between laps of both a fixed scroll and a movable scroll by revolving and turning the movable scroll with respect to the fixed scroll.

BACKGROUND ART

This type of scroll compressor conventionally includes a compression mechanism constituted of a fixed scroll having a spiral lap on the surface of a mirror plate and a movable scroll having a spiral lap on the surface of a mirror plate and is configured in such a manner that a compression chamber is formed between the laps of the respective scrolls with the laps facing each other, and the movable scroll is revolved and turned with respect to the fixed scroll to thereby compress a working fluid (refrigerant) in the compression chamber (refer to, for example, Patent Document 1).

Further, in Patent Document 1, a relief passage which communicates a discharge space (discharge chamber of Patent Document 1) and a discharge passage with each other is formed, and a relief valve which opens by a pressure difference is provided in this relief passage. In addition, the relief passage is made open in the discharge space (discharge chamber) below a discharge hole (discharge port in the Document) to discharge liquid accumulated in the discharge space (discharge chamber) to the discharge passage.

CITATION LIST

Patent Documents

Patent Document 1: Japanese Patent Application Laid-Open No. 2010-151060

SUMMARY OF THE INVENTION

Problems to be Solved by the Invention

Here, in this type of scroll compressor, a muffler chamber for reducing pulsation and an oil separator described even in Patent Document 1 described above are normally arranged between the discharge space and the discharge port. Then, the working fluid discharged from the discharge hole of the fixed scroll into the discharge space reaches the discharge port after having passed through the oil separator and the muffler chamber of these.

Therefore, there is a problem that especially under high volume flow rate conditions of the working fluid (discharge gas) discharged from the discharge hole, a pressure loss is generated due to passing of the working fluid through the oil separator and the muffler chamber, and the efficiency is lowered. In this regard, since there is shown in Patent Document 1 described above, the structure in which the relief passage is opened below the discharge hole, and the liquid accumulated in the discharge space is discharged to the discharge passage, the above-mentioned effect of reducing the pressure loss cannot be expected.

The present invention has been made to solve such conventional technical problems, and it is an object of the present invention to provide a scroll compressor capable of effectively reducing a pressure loss in a pathway from a discharge space to a discharge port.

Means for Solving the Problems

A scroll compressor of the present invention is provided which includes a compression mechanism provided in a housing, having a fixed scroll and a movable scroll respectively formed at surfaces of mirror plates with spiral laps facing each other, and in which the movable scroll is revolved and turned with respect to the fixed scroll to thereby compress a working fluid in a compression chamber formed between the laps of both scrolls. The scroll compressor is characterized by having a discharge space formed in the housing, a discharge hole which is formed in the fixed scroll and discharges the compressed working fluid to the discharge space, a discharge port which discharges the working fluid to the outside of the housing, a relief passage which communicates the discharge space and the discharge port with each other, and a differential pressure valve which is provided in the relief passage and opens in accordance with a pressure difference between the discharge space and the discharge port, and in that the relief passage opens in the discharge space above the discharge hole.

The scroll compressor of the invention of claim 2 is characterized in the above invention by including a muffler chamber located between the discharge space and the discharge port and formed in the housing so as to communicate them with each other, and in that the relief passage communicates the discharge space and the discharge port with each other without passing through the muffler chamber.

The scroll compressor of the invention of claim 3 is characterized in the above invention by including an oil separator configured in the discharge space, and in that the working fluid discharged from the discharge hole flows into the muffler chamber after passing through the oil separator, and the relief passage communicates the discharge space and the discharge port with each other without passing through the oil separator and the muffler chamber.

The scroll compressor of the invention of claim 4 is characterized in the invention of claim 2 by including an oil separator configured in the discharge space, and in that the working fluid discharged from the discharge hole flows into the muffler chamber after passing through the oil separator, and the relief passage communicates a working fluid outlet of the oil separator and the discharge port with each other without passing through the muffler chamber.

The scroll compressor of the invention of claim 5 is characterized in that in the above respective inventions, the differential pressure valve opens when the pressure in the discharge space becomes higher than the pressure in the discharge port and the difference between them reaches a predetermined value PD1.

The scroll compressor of the invention of claim 6 is characterized in the above invention by including a discharge valve which is provided at the discharge hole and opens when a pressure difference between the compression chamber and the discharge space reaches a predetermined value PD2, and in that the predetermined value PD1 is larger than the predetermined value PD2.

Advantageous Effect of the Invention

According to the present invention, a relief passage is formed which communicates a discharge space to which a working fluid is discharged from a discharge hole of a fixed scroll and a discharge port discharging the working fluid to the outside of a housing with each other. A differential pressure valve which opens in accordance with a pressure difference between the discharge space and the discharge port is provided in the relief passage. The relief passage is made open in the discharge space above the discharge hole. Therefore, as described in claims 2 to 4 under high volume flow rate conditions of the working fluid, it becomes possible to effectively reduce a pressure loss in a muffler chamber provided between the discharge space and the discharge port and an oil separator configured in the discharge space, and improve the efficiency.

Further, since the degree of freedom is increased in designing the muffler chamber, the discharge pulsation under low speed conditions can also be effectively reduced. Further, by setting the conditions under which the differential pressure valve is opened, as in claim 5 and 6, the pressure loss can be smoothly reduced.

MODE FOR CARRYING OUT THE INVENTION

Hereinafter, an embodiment of the present invention will be described in detail with reference to the drawings.

Embodiment 1

Figure 1:
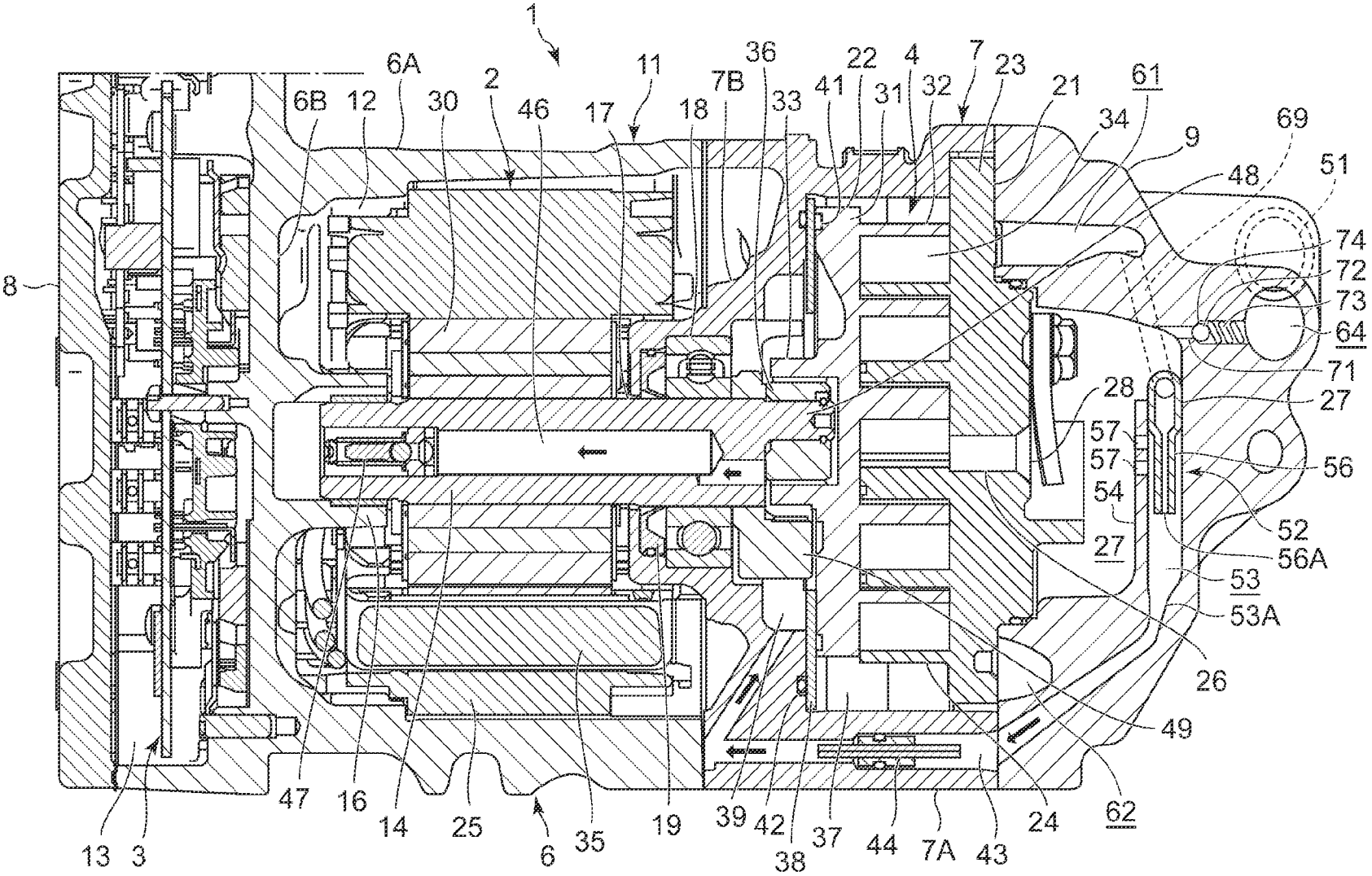
FIG. 1 is a cross-sectional view of a scroll compressor of an embodiment to which the present invention is applied.

FIG. 1 is a cross-sectional view of a scroll compressor of an embodiment to which the present invention is applied. The scroll compressor 1 of this embodiment is, for example, a so-called inverter-integrated scroll compressor which is used in a refrigerant circuit R (FIG. 3) of a vehicle air conditioning device, sucks a carbon dioxide refrigerant as a working fluid of the vehicle air conditioning device, and compresses and discharges it, and which includes an electric motor 2, an inverter 3 for operating the electric motor 2, and a compression mechanism 4 driven by the electric motor 2.

The scroll compressor 1 of the embodiment includes a main housing 6 which accommodates the electric motor 2 and the inverter 3 thereinside, a compression mechanism housing 7 which accommodates the compression mechanism 4 thereinside, an inverter cover 8, and a compression mechanism cover 9. Then, the main housing 6, the compression mechanism housing 7, the inverter cover 8, and the compression mechanism cover 9 are all made of metal (made of aluminum in the embodiment). They are integrally joined to constitute a housing 11 of the scroll compressor 1. That is, the compression mechanism cover 9 constitutes a part of the housing 11.

The main housing 6 is constituted of a tubular peripheral wall portion 6A and a partition wall portion 6B. The partition wall portion 6B is a partition wall which partitions the inside of the main housing 6 into a motor accommodating portion 12 accommodating the electric motor 2 and an inverter accommodating portion 13 accommodating the inverter 3. One end surface of the inverter accommodating portion 13 is open, and this opening is closed by the inverter cover 8 after the inverter 3 is accommodated therein.

The other end surface of the motor accommodating portion 12 is also open, and this opening is closed by the compression mechanism housing 7 after the electric motor 2 is accommodated therein. A support portion 16 for supporting one end portion (end portion on the side opposite to the compression mechanism 4) of a rotating shaft 14 of the electric motor 2 is protrusively provided at the partition wall portion 6B.

The compression mechanism housing 7 has an opening on the side opposite to the main housing 6, and this opening is closed by the compression mechanism cover 9 after the compression mechanism 4 is accommodated therein. The compression mechanism housing 7 is constituted of a tubular peripheral wall portion 7A and a frame portion 7B on one end side (main housing 6 side) thereof. The compression mechanism 4 is accommodated in a space partitioned by the peripheral wall portion 7A and the frame portion 7B. The frame portion 7B forms a partition wall which partitions the inside of the main housing 6 from the inside of the compression mechanism housing 7.

Further, the frame portion 7B is provided with a through hole 17 to insert the other end of the rotating shaft 14 of the electric motor 2 (the end on the compression mechanism 4 side). A front bearing 18 as a bearing member which supports the other end of the rotating shaft 14 is fitted to the compression mechanism 4 side of the through hole 17. Further, reference numeral 19 denotes a seal material which seals the outer peripheral surface of the rotating shaft 14 and the inside of the compression mechanism housing 7 at the portion of the through hole 17.

The electric motor 2 is constituted of a stator 25 around which a coil 35 is wound and a rotor 30. Then, for example, a direct current from a battery (not shown) of a vehicle is converted into a three-phase alternating current by the inverter 3, which is supplied to the coil 35 of the electric motor 2, so that the rotor 30 is configured to be rotationally driven.

Further, an unillustrated suction port is formed in the main housing 6. After the refrigerant sucked from the suction port passes through the inside of the main housing 6, the refrigerant is sucked into a suction portion 37 to be described later outside the compression mechanism 4 in the compression mechanism housing 7. Consequently, the electric motor 2 is cooled by the sucked refrigerant. In addition, as will be described later, after the refrigerant compressed by the compression mechanism 4 is discharged to a discharge space 27, the refrigerant is configured to be finally discharged from a discharge port 51 formed in the compression mechanism cover 9 to the outside of the housing 11, i.e., the refrigerant circuit R.

The compression mechanism 4 is constituted of a fixed scroll 21 and a movable scroll 22. The fixed scroll 21 integrally has a disk-shaped mirror plate 23 and a spiral lap 24 comprised of an involute shape or a curved line approximated thereto, which stands on the surface (one surface) of the mirror plate 23. The surface of the mirror plate 23 on which the lap 24 is vertically provided is fixed to the compression mechanism housing 7 as the frame portion 7B side. A discharge hole 26 is formed in the center of the mirror plate 23 of the fixed scroll 21. The discharge hole 26 communicates with the discharge space 27 in the compression mechanism cover 9. Reference numeral 28 denotes a discharge valve provided at the opening on the back surface (the other surface) side of the mirror plate 23 in the discharge hole 26. The discharge valve 28 opens when the pressure in the compression chamber 34 becomes higher than the pressure in the discharge space 27 and their differential pressure reaches a predetermined value PD2, and communicates the discharge hole 26 with the discharge space 27.

The movable scroll 22 is a scroll which revolves and turns with respect to the fixed scroll 21, and integrally includes a disk-shaped mirror plate 31, a spiral lap 32 comprised of an involute shape or a curved line approximated thereto, which stands on the surface (one surface) of the mirror plate 31, and a boss portion 33 formed to protrude in the center of the back surface (the other surface) of the mirror plate 31. The movable scroll 22 is arranged so that the lap 32 faces the lap 24 of the fixed scroll 21 and they face each other and mesh with each other with the protruding direction of the lap 32 as the fixed scroll 21 side, and a compression chamber 34 is formed between the laps 24 and 32.

That is, the lap 32 of the movable scroll 22 faces the lap 24 of the fixed scroll 21 and meshes with the lap 24 so that the tip of the lap 32 comes into contact with the surface of the mirror plate 23 and the tip of the lap 24 comes into contact with the surface of the mirror plate 31. The other end of the rotating shaft 14, that is, the end on the movable scroll 22 side is provided with a drive protrusion 48 which protrudes at a position eccentric from the axial center of the rotating shaft 14. Then, an eccentric bush 36 is attached to the drive protrusion 48 and provided eccentrically from the axial center of the rotating shaft 14 at the other end of the rotating shaft 14.

In this case, the eccentric bush 36 is attached to the drive protrusion 48 at a position eccentric from the axial center of the eccentric bush 36. The eccentric bush 36 is fitted to the boss portion 33 of the movable scroll 22. Then, when the rotating shaft 14 is rotated together with the rotor 30 of the electric motor 2, the movable scroll 22 is configured to revolve and turn with respect to the fixed scroll 21 without rotating on its axis. Incidentally, reference numeral 49 denotes a balance weight attached to the outer peripheral surface of the rotating shaft 14 on the movable scroll 22 side from the front bearing 18.

Since the movable scroll 22 revolves and turns eccentrically with respect to the fixed scroll 21, the eccentric direction and the contact position of each of the laps 24 and 32 are moved while rotating, and the compression chamber 34 having sucked the refrigerant from the above-mentioned suction portion 37 on the outside is gradually reduced while moving toward the inside. Consequently, the refrigerant is compressed and finally discharged from the central discharge hole 26 to the discharge space 27 through the discharge valve 28.

In FIG. 1, reference numeral 38 is an annular thrust plate. The thrust plate 38 is for partitioning a back pressure chamber 39 formed on the back surface side of the mirror plate 31 of the movable scroll 22 and the suction portion 37 as a suction pressure region outside the compression mechanism 4 in the compression mechanism housing 7. The thrush plate 38 is located outside the boss portion 33 and interposed between the frame portion 7B and the movable scroll 22. Reference numeral 41 is a seal material which is attached to the back surface of the mirror plate 31 of the movable scroll 22 and abuts against the thrust plate 38. The back pressure chanter 39 and the suction portion 37 are partitioned by the seal material 41 and the thrust plate 38.

Incidentally, reference numeral 42 is a seal material which is attached to the surface of the frame portion 7B on the thrust plate 38 side, abuts against the outer peripheral portion of the thrust plate 38, and seals between the frame portion 7B and the thrust plate 38.

Further, in FIG. 1, reference numeral 43 denotes a back pressure passage formed from the compression mechanism cover 9 to the compression mechanism housing 7. An orifice 44 is installed in the back pressure passage 43. The back pressure passage 43 communicates an oil outlet 53A of an oil separator 52 configured in the discharge space 27 of the compression mechanism cover 9 with the back pressure chamber 39, whereby as shown by an arrow in FIG. 1, the back pressure chamber 39 is configured to be supplied with oil having discharge pressure adjusted by reducing the pressure at the orifice 44.

The pressure (back pressure) in the back pressure chamber 39 causes a back pressure load which presses the movable scroll 22 against the fixed scroll 21. Due to this back pressure load, the movable scroll 22 is pressed against the fixed scroll 21 against a compressive reaction force from the compression chamber 34 of the compression mechanism 4, so that the contacts between the laps 24 and 32 and the mirror plates 31 and 23 are maintained, thereby making it possible to compress the refrigerant in the compression chamber 34.

On the other hand, an oil passage 46 extending in the axial direction is formed in the rotating shaft 14. A pressure adjusting valve 47 is provided in the oil passage 46 with being located on the support portion 16 side. The oil passage 46 communicates the back pressure chamber 39 with the inside of the main housing 6 (suction pressure region). The oil flowing into the back pressure chamber 39 from the back pressure passage 43 flows into the oil passage 46 and flows out into the main housing 6. However, the pressure adjusting valve 47 is made open when the pressure (back pressure) in the back pressure chamber 39 reaches the maximum value, and functions so that the back pressure does not rise any more.

Figure 2:
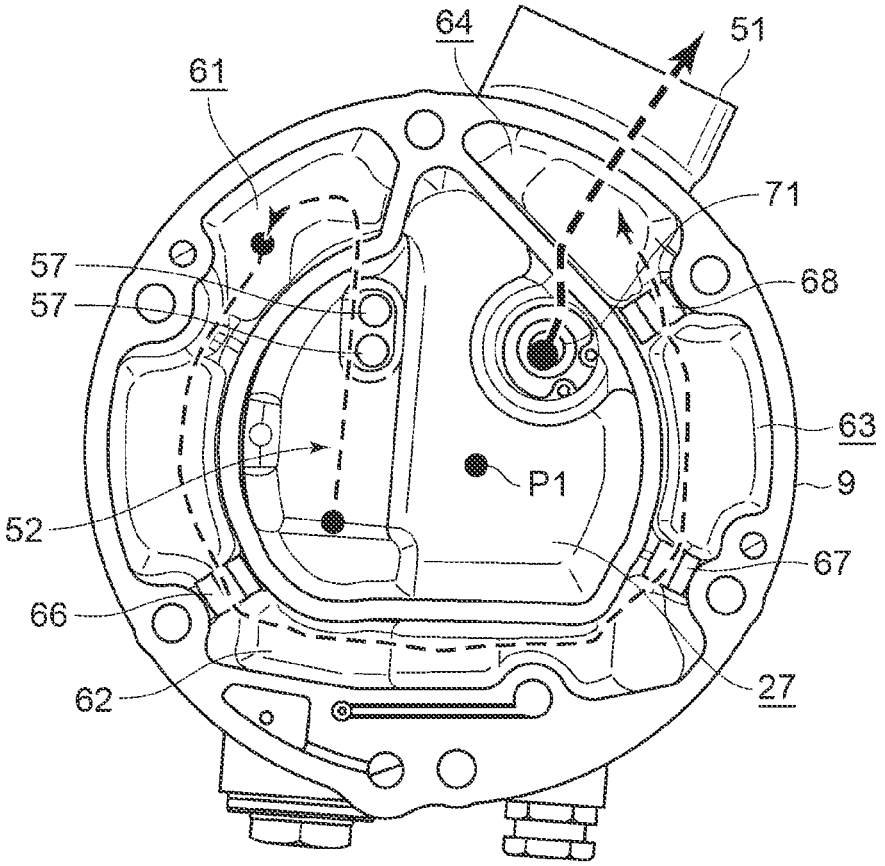
FIG. 2 is a front view of a compression mechanism cover of the scroll compressor of FIG. 1.

Next, the detailed structure of the above-mentioned compression mechanism cover 9 which constitutes a part of the housing 11 will be described with reference to FIGS. 1 and 2. As described above, the oil separator 52 is configured in the discharge space 27. The oil separator 52 is formed integrally with the compression mechanism cover 9, and is constituted of an oil separation portion 54 having an oil separation space 53 constituted thereinside, an oil separation cylinder 56 which is inserted into the oil separation portion 54 from above to seal an upper portion of the oil separation space 53 and whose refrigerant outlet (working fluid outlet) 56A at the lower end of the oil separation cylinder 56 is opened in the oil separation space 53, and two communication holes 57 and 57 which are formed so as to face the side surface of the oil separation cylinder 56 and communicate the discharge space 27 and the oil separation space 53 other than the oil separator 52. The lower end of the oil separation space 53 is defined as the oil outlet 53A described above.

Further, in the compression mechanism cover 9, a plurality of muffler chambers 61, 62, and 63 and a discharge port chamber 64 are configured to be located around the discharge space 27. The muffler chamber 61 and the muffler chanter 62 are communicated by a throttle portion 66. The muffler chamber 62 and the muffler chamber 63 are communicated by a throttle portion 67. The muffler chamber 63 and the discharge port chamber 64 are communicated by a throttle portion 68. The first muffler chamber 61 and the upper portion of the oil separation cylinder 56 of the oil separator 52 are communicated by a communication passage 69. Further, the discharge port chamber 64 is communicated with the discharge port 51 to form a part of the discharge port 51.

Further, in the present invention, a relief passage 71 is formed in the compression mechanism cover 9, and a differential pressure valve 74 constituted of a ball valve 72 and a compression spring 73 is provided in the relief passage 71. One end of the relief passage 71 is open to the discharge space 27 above the discharge hole 26 of the fixed scroll 21, and the other end is open to the discharge port chamber 64, whereby the discharge space 27 and the discharge port chamber 64 (discharge port 51) are communicated with each other. Incidentally, what is shown by P1 in FIG. 2 is the position of the discharge hole 26 in FIG. 1

Further, the compression spring 73 of the differential pressure valve 74 always presses the ball valve 72 against a valve seat (formed in the relief passage 71) to close the relief passage 71 (the differential pressure valve 74 is closed). However, when the pressure of the discharge space 27 becomes higher than the pressure of the discharge port chamber 64 (discharge port 51) and their differential pressure reaches a predetermined value PD1, the compression spring 73 is configured so that the ball valve 72 separates from the valve seat against a spring force of the compression spring 73 to open the relief passage 71 (the differential pressure valve 74 is opened).

Here, it is assumed that the spring force of the compression spring 73 is set so that the predetermined value PD1 of the differential pressure which opens the differential pressure valve 74 becomes larger than the predetermined value PD2 of the differential pressure between the compression chamber 34 and the discharge space 27, which opens the above-described discharge valve 28.

Figure 3:
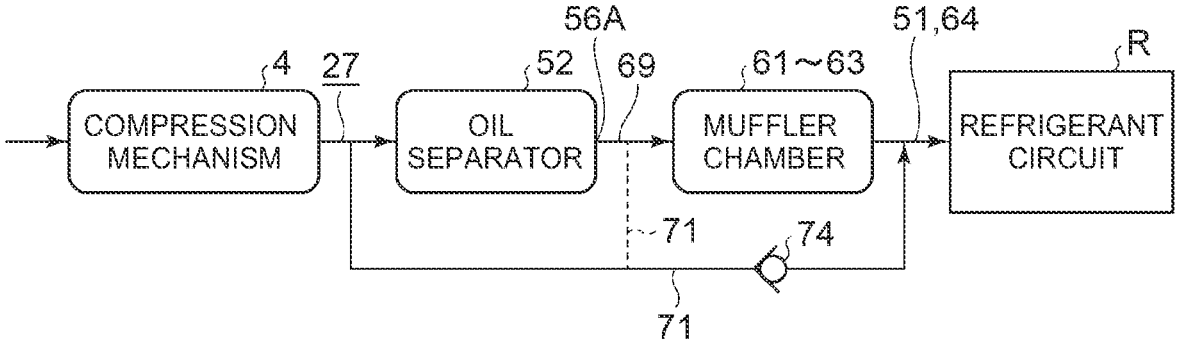
FIG. 3 is a view explaining the flow of a refrigerant (working fluid) from a compression mechanism of the scroll compressor of FIG. 1 to a refrigerant circuit.

With the above configuration, the flow of the refrigerant from the compression mechanism 4 to the refrigerant circuit R will next be described with reference to FIG. 3. When the refrigerant is compressed by the turning of the movable scroll 22 with respect to the fixed scroll 21 as described above, and the differential pressure between the compression chamber 34 and the discharge space 27 reaches the predetermined value PD2, the discharge valve 28 is opened to discharge the refrigerant from the discharge hole 26 to the discharge space 27. Incidentally, it is assumed that the differential pressure valve 74 is closed in a normal operating state in which the volume flow rate of the refrigerant (discharged gas) is relatively low.

The refrigerant (including oil) which has flowed into the discharge space 27 in this way flows into the oil separation space 53 of the oil separator 52 from the communication holes 57 and 57, and swirls around the oil separation cylinder 56. The oil in the refrigerant is separated by the centrifugal force at this time, and the separated oil is supplied from the oil outlet 53A to the back pressure chamber 39 as described above via the back pressure passage 43 and the orifice 44.

On the other hand, the refrigerant from which the oil has been separated flows into the oil separation cylinder 56 from the refrigerant outlet 56A and flows into the muffler chamber 61 via the communication passage 69. Then, the refrigerant flows into the discharge port chamber 64 through the throttle portion 66, the muffler chamber 62, the throttle portion 67, the muffler chamber 63, and the throttle portion 68 sequentially, and is finally discharged from the discharge port 51 to the refrigerant circuit R outside the housing 11. (flow on the upper side of FIG. 3).

The amount of oil flowing out to the refrigerant circuit R is suppressed by the above-described oil separator 52, and the pulsation of the refrigerant discharged to the refrigerant circuit R by the muffler chambers 61 to 63 and the throttle portions 66 to 63 is reduced. However, under the high volume flow rate conditions of the refrigerant (discharged gas) discharged from the discharge hole 26, a pressure loss occurs by passing of the refrigerant through the oil separator 52 and the muffler chambers 61 to 63, and the efficiency is lowered.

Therefore, in the present invention, the relief passage 71 and the differential pressure valve 74 described above are provided. That is, when the pressure loss becomes large under the high volume flow rate conditions as described above, the pressure in the discharge space 27 rises more than the pressure in the discharge port chamber 64 (discharge port 51), and the differential pressure between them has reached the predetermined value PD1 described above, the differential pressure valve 74 opens to open the relief passage 71, whereby the discharge space 27 and the discharge port chamber 64 (discharge port 51) are communicated without passing through the oil separator 52 and the muffler chambers 61 to 63, i.e., bypassing them.

Consequently, the refrigerant in the discharge space 27 bypasses the oil separator 52 and the muffler chambers 61 to 63 without passing through them and flows into the discharge port chamber 64 (discharge port 51). Therefore, the pressure loss in the oil separator 52 and the muffler chambers 61 to 63 is effectively reduced, and the efficiency is improved. Further, since the degree of freedom increases in designing the muffler chambers 61 to 63, the discharge pulsation under low speed conditions can also be effectively reduced. Further, in the embodiment, the above-mentioned predetermined value PD1 at which the differential pressure valve 74 opens is made larger than the above-mentioned predetermined value PD2 at which the discharge valve 28 opens, so that the pressure loss can be smoothly reduced.

Embodiment 2

Incidentally, in the above embodiment, the discharge space 27 and the discharge port chamber 64 (discharge port 51) are communicated with each other by the relief passage 71 provided with the differential pressure valve 74, but the present invention is not limited thereto. As shown by a broken line in FIG. 73, the refrigerant outlet (working fluid outlet) 56A of the oil separation cylinder 56 from which the refrigerant flows out from the oil separator 52, or the communication passage 69, and the discharge port chamber 64 (discharge port 51) may be communicated with each other by the relief passage 71.

Even by that, the refrigerant in the discharge space 27 bypasses the muffler chambers 61 to 63 without passing through them and flows into the discharge port chamber 64 (discharge port 51), so that the pressure loss in the muffler chambers 61 to 63 is effectively reduced.

Incidentally, in the embodiment, the present invention is applied to the scroll compressor used in the refrigerant circuit of the vehicle air conditioning device, but the present invention is not limited thereto. The present invention is effective for a scroll compressor used in each of refrigerant circuits of various refrigerating devices. Further, in the embodiment, the present invention is applied to the so-called inverter-integrated scroll compressor, but is not limited thereto. The present invention can also be applied to a normal scroll compressor not integrally provided with an inverter.

DESCRIPTION OF REFERENCE NUMERALS

1 scroll compressor
4 compression mechanism
6 main housing (part of housing 11)
7 compression mechanism housing (part of housing 11)
9 compression mechanism cover (part of housing 11)
11 housing
21 fixed scroll
22 movable scroll
23, 31 mirror plate
24, 32 lap
26 discharge hole
27 discharge space
28 discharge valve
34 compression chamber
51 discharge port
52 oil separator
61 to 63 muffler chamber
64 discharge port chamber (part of discharge port)
69 communication passage
71 relief passage
74 differential pressure valve.

The invention claimed is:

1. A scroll compressor comprising:

a compression mechanism provided in a housing, which includes a fixed scroll and a movable scroll respectively formed at surfaces of mirror plates with spiral laps facing each other, wherein the movable scroll is revolved and turned with respect to the fixed scroll to thereby compress a working fluid in a compression chamber formed between the laps of both scrolls, wherein the scroll compressor includes:

a discharge space formed in the housing, a discharge hole which is formed in the fixed scroll and discharges the compressed working fluid to the discharge space, a discharge port which discharges the working fluid to the outside of the housing, a relief passage which communicates the discharge space and the discharge port with each other, and a differential pressure valve which is provided in the relief passage and opens in accordance with a pressure difference between the discharge space and the discharge port, wherein the relief passage opens in the discharge space above the discharge hole, wherein the scroll compressor includes a muffler chamber located between the discharge space and the discharge port and formed in the housing so as to communicate the discharge space and the discharge port with each other, wherein the scroll compressor includes an oil separator configured in the discharge space, wherein the working fluid discharged from the discharge hole flows into the muffler chamber after passing through the oil separator, and wherein the relief passage communicates the discharge space and the discharge port with each other without passing through the oil separator and the muffler chamber.

2. The scroll compressor according to claim 1, wherein the relief passage communicates a working fluid outlet of the oil separator and the discharge port with each other without passing through the muffler chamber.

3. The scroll compressor according to claim 2, wherein the differential pressure valve opens when the pressure in the discharge space becomes higher than the pressure in the discharge port and the difference between them reaches a predetermined value PD1.

4. The scroll compressor according to claim 1, wherein the differential pressure valve opens when the pressure in the discharge space becomes higher than the pressure in the discharge port and the difference between them reaches a predetermined value PD1.

5. The scroll compressor according to claim 4, including a discharge valve which is provided at the discharge hole and opens when a pressure difference between the compression chamber and the discharge space reaches a predetermined value PD2, wherein the predetermined value PD1 is larger than the predetermined value PD2.

6. The scroll compressor according to claim 1, wherein the differential pressure valve opens when the pressure in the discharge space becomes higher than the pressure in the discharge port and the difference between them reaches a predetermined value PD1.

* * * * *